US007119822B2

(12) United States Patent
Kobayashi et al.

(10) Patent No.: US 7,119,822 B2
(45) Date of Patent: Oct. 10, 2006

(54) PRINTER AND CONSUMABLES FOR USE IN PRINTER

(75) Inventors: Yozo Kobayashi, Fuji (JP); Mitsuo Uchimura, Numazu (JP); Hiroyuki Koyama, Mishima (JP); Ryohei Miyoshi, Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 183 days.

(21) Appl. No.: 10/808,798

(22) Filed: Mar. 25, 2004

(65) Prior Publication Data

US 2005/0024465 A1 Feb. 3, 2005

(30) Foreign Application Priority Data

Mar. 28, 2003 (JP) ..... 2003-090139

(51) Int. Cl.
*B41J 2/32* (2006.01)

(52) U.S. Cl. ..... 347/197

(58) Field of Classification Search ..... 347/188, 347/193, 214, 217, 171–172, 219; 400/208, 400/611, 196, 612, 207, 613
See application file for complete search history.

(56) References Cited

U.S. PATENT DOCUMENTS 6,227,643 B1 5/2001 Purcell et al.
6,593,952 B1 * 7/2003 Funayama et al. ..... 347/193
2001/0007458 A1 7/2001 Purcell et al.
2002/0191998 A1 12/2002 Cremon et al.

FOREIGN PATENT DOCUMENTS

| | | | |
|---|---|---|---|
| CN | 1082892 | C | 4/2002 |
| JP | 01-297266 | A | 11/1989 |
| JP | 05-205084 | A | 8/1993 |
| JP | 06-122224 | A | 5/1994 |
| JP | 2001-080098 | A | 3/2001 |
| JP | 2001-354343 | A | 12/2001 |

OTHER PUBLICATIONS

European Examination Report issued in 04 251 755.7 2304 dated Dec. 8, 2005, Applicant: Toshiba Tec Kabhshiki Kaisha.

* cited by examiner

*Primary Examiner*—K. Feggins
(74) *Attorney, Agent, or Firm*—Frishauf, Holtz, Goodman & Chick, P.C.

(57) ABSTRACT

A consumable for use in a printer has a consumable section (for example, paper or ink ribbon) which is consumed during printing operation of the printer, and an RFID tag that stores the specification data of the consumable section. The printer has a printing section and a wireless receiver for data communication with the RFID tag. The printing section is controlled according to data obtained from the RFID tag through data communication.

3 Claims, 13 Drawing Sheets

Fig. 5

T

| |
|---|
| Pulse width table by thermistor value for head resistance rank 1 |
| Pulse width table by thermistor value for head resistance rank 2 |
| |
| Pulse width table by thermistor value for head resistance rank 16 |

| Temperature rank | Temperature range | Pulse width (ms) | |
|---|---|---|---|
| | | Black | Blue |
| 0 | a | 0.ZZZ | 0.ZZZ |
| 1 | b | 0.ZZZ | 0.ZZZ |
| 2 | c | 0.ZZZ | 0.ZZZ |
| 3 | d | 0.ZZZ | 0.ZZZ |
| 4 | e | 0.ZZZ | 0.ZZZ |
| 5 | f | 0.ZZZ | 0.ZZZ |
| 6 | g | 0.ZZZ | 0.ZZZ |
| 7 | h | 0.ZZZ | 0.ZZZ |
| 8 | i | 0.ZZZ | 0.ZZZ |
| 9 | j | 0.ZZZ | 0.ZZZ |
| A | k | 0.ZZZ | 0.ZZZ |
| B | l | 0.ZZZ | 0.ZZZ |
| C | m | 0.ZZZ | 0.ZZZ |
| D | n | 0.ZZZ | 0.ZZZ |
| E | o | 0.ZZZ | 0.ZZZ |
| F | p | 0.ZZZ | 0.ZZZ |

Fig. 7

| |
|---|
| Pulse width table by thermistor value for head resistance rank 1 |
| Pulse width table by thermistor value for head resistance rank 2 |
| |
| |
| Pulse width table by thermistor value for head resistance rank 16 |

r

| Temperature rank | Temperature rank | Printing Speed (l/s) | Energy pulse width (ms) | |
|---|---|---|---|---|
| | | | Blue | Black |
| 0 | a | 10 | 0.ZZZ | unprintable |
| | | 6 | 0.ZZZ | 0.ZZZ |
| | | 3 | 0.ZZZ | 0.ZZZ |
| 1 | b | 10 | 0.ZZZ | 0.ZZZ |
| | | 6 | 0.ZZZ | 0.ZZZ |
| | | 3 | 0.ZZZ | 0.ZZZ |
| | | | | |

Fig. 12 t

| | | Electric energy pulse width (ms) | | | | | |
|---|---|---|---|---|---|---|---|
| Transfer ribbon | | Wax | Wax | Semi-resin | Semi-resin | Resin | Resin |
| Paper | | Wood-free | Rough | Wood-free | Coated | Coated | PET |
| Printing speed (l/s) | 10 | 0.ZZZ | unprintable | 0.ZZZ | unprintable | unprintable | unprintable |
| | 6 | 0.ZZZ | 0.ZZZ | 0.ZZZ | 0.ZZZ | 0.ZZZ | 0.ZZZ |
| | 3 | 0.ZZZ | 0.ZZZ | 0.ZZZ | 0.ZZZ | 0.ZZZ | 0.ZZZ |

PRINTER AND CONSUMABLES FOR USE IN PRINTER

CROSS REFERENCE TO RELATED APPLICATION

The present application is based on Japanese Priority Document P2003-90139 filed on Mar. 28, 2003, the content of which is incorporated herein by reference.

BACKGROUND OF THE INVENTION

1. Field of the Invention

The present invention relates to a printer and also to consumables which are consumed while a printer performs printing.

2. Description of the Background

A printer consumes various consumables during printing operation. In receipt printers incorporated into POS (Point of Sale) terminals, a typical consumable is receipt paper. In label printers, a typical consumable is label paper. In thermal printers, a typical consumable is heat-sensitive paper. In thermal transfer printers, recording paper and ink ribbon are typical consumables.

Different consumables have different physical properties. Therefore, the printing conditions of the printer must be adjusted depending on the properties of the consumable to be used. For example, in a thermal printer, the electrical energy supplied to the thermal head must be adjusted depending on the properties of the heat-sensitive paper to be used. Another example is a thermal transfer printer that adjusts the printing speed depending on the combination of recording paper and ink ribbon to be used.

However, adjusting the various printing conditions depending on the properties of various consumables is a troublesome task. Conventional printers require that printing conditions be adjusted according to the consumables to be used and therefore have the problem that these troublesome adjustments of the printing conditions are required.

SUMMARY OF THE INVENTION

Therefore, an object of the present invention is to make adjusting the various printing conditions easy for different types of consumables even in printers using different types of consumables.

A novel consumable according to the present invention is used in order to achieve the object of the present invention.

The consumable according to the present invention has a consumable section which is consumed during printing operation of a printer, and an RFID tag which stores specification data of the consumable.

The novel printer according to the present invention is used in order to achieve the object of the present invention.

The printer according to the present invention comprises: a printing section with a print head; and a holder which holds the consumable, the consumable being consumed during printing operation of the printing section and provided with an RFID tag which stores the consumable specification data, and controls the printing section based on the data obtained from the RFID tag through data communication.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 5 is a schematic diagram showing a pulse width table;

FIG. 7 is a schematic diagram showing another example of a pulse width table;

FIG. 12 shows a pulse width table; and

DETAILED DESCRIPTION OF THE PREFERRED EMBODIMENTS

A preferred embodiment of the present invention is described next while referring to FIGS. 1 through 7. A printer according to this embodiment is a receipt printer connected with a POS (Point of Sale) terminal. The receipt printer is a thermal printer.

Figure 1:
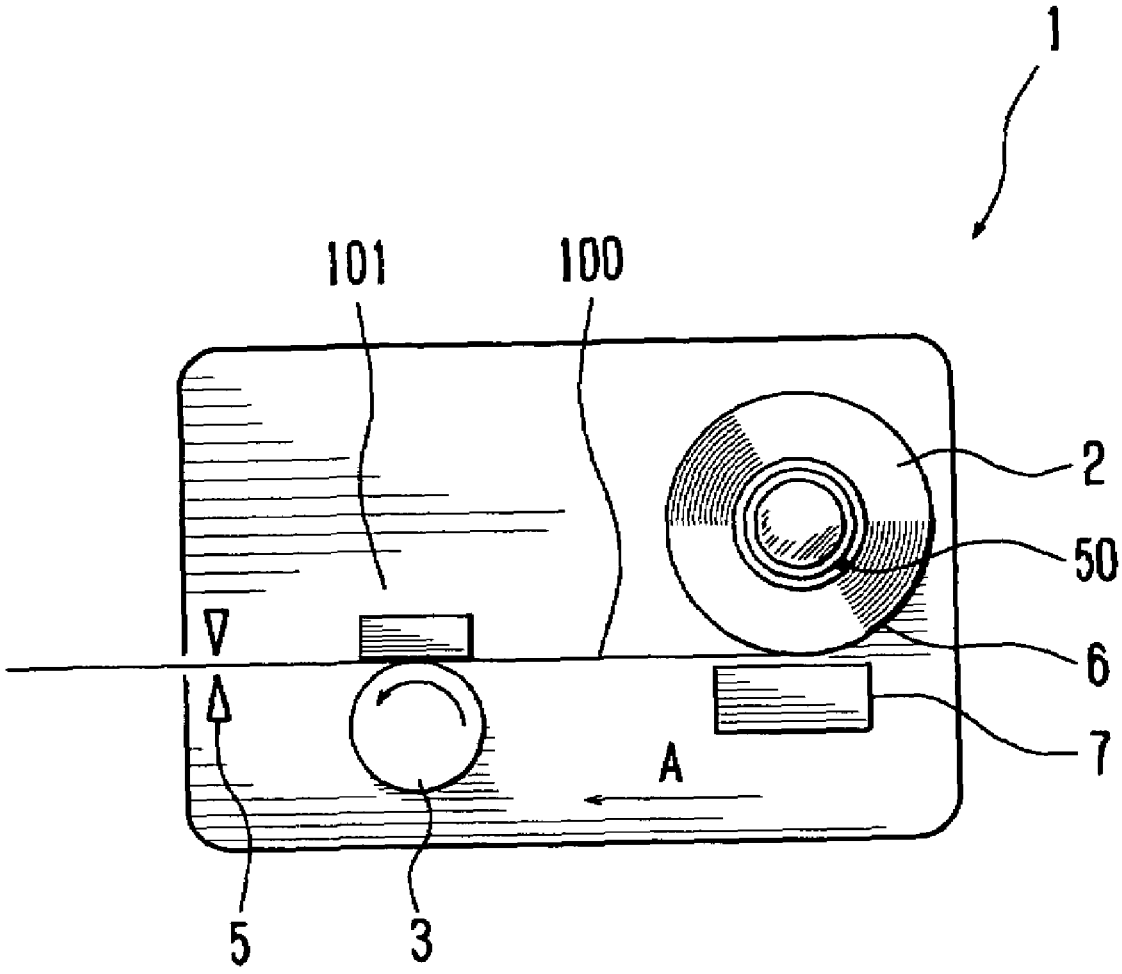
FIG. 1 is a longitudinal sectional side view schematically showing the structure of a receipt printer according to an embodiment of the present invention.

FIG. 1 is a longitudinal sectional side view schematically showing the structure of a receipt printer 1. As shown in FIG. 1, the receipt printer 1 has a holder 6 for holding a roll of receipt paper 2. The receipt printer 1 has a platen 3 and a thermal head 4 facing the platen 3 with a paper path 100 between them. The platen 3 and the thermal head 4 make up a printing section 101. The platen 3 is rotated by being driven by a stepping motor 14 (see FIG. 3) to move the receipt paper 2 held by the holder 6 in a paper feeding direction A. The thermal head 4 is a print head with an array of heating resistors (not shown). The thermal head 4 generates heat selectively to perform thermal printing on the receipt paper 2. The thermal head 4 has a thermistor 4*a* as a sensor for detecting the temperature of the thermal head 4 (see FIG. 3). The receipt printer 1 also has a cutter 5 that cuts the printed receipt paper 2.

Figure 2:
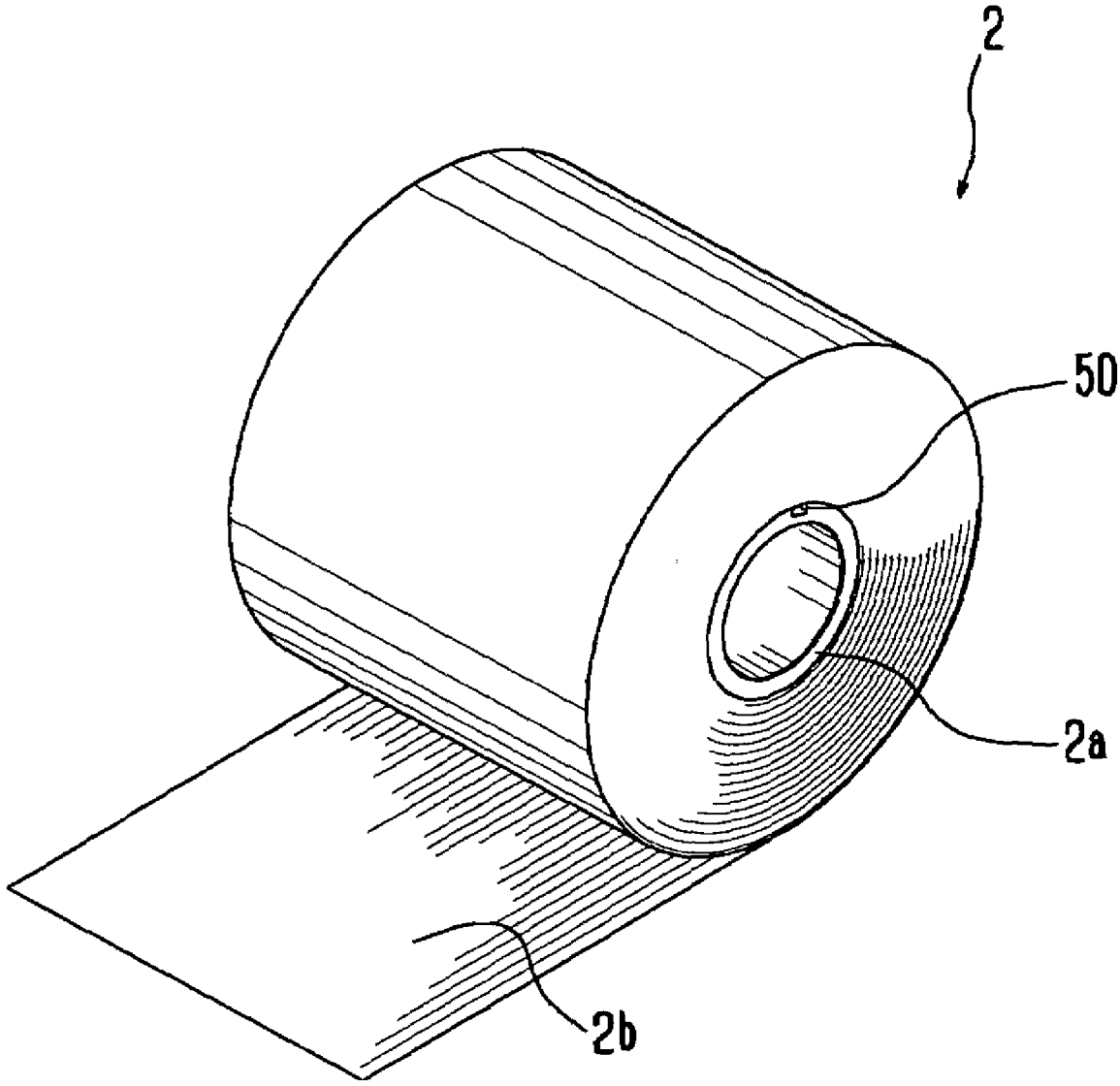
FIG. 2 is a perspective view showing a receipt paper.

FIG. 2 is a perspective view showing the receipt paper 2 (roll). The receipt paper 2 is consumed while the printing section 101 performs printing. The receipt paper 2 is therefore a consumable. The receipt paper 2 consists of a cylindrical core 2*a* and a roll of paper 2*b* (web) wound around the core 2*a*. This core 2*a* and the paper 2*b* are consumables. The paper 2*b* is heat-sensitive paper. An RFID tag is embedded in the core 2*a*. Here, RFID is an abbreviation for Radio Frequency Identification. The RFID tag 50 is composed of a silicon chip and an antenna and is capable of sending data to a wireless receiver.

The receipt printer 1 receives data from the RFID tag 50 wirelessly (radio). This means that the receipt printer 1 has a wireless receiver 7. The wireless receiver 7 is located near a holder which holds the receipt paper 2. For wireless communication between the RFID tag 50 and the wireless receiver 7, an electrostatic coupling, electromagnetic coupling, microwave or other method may be used.

Figure 3:
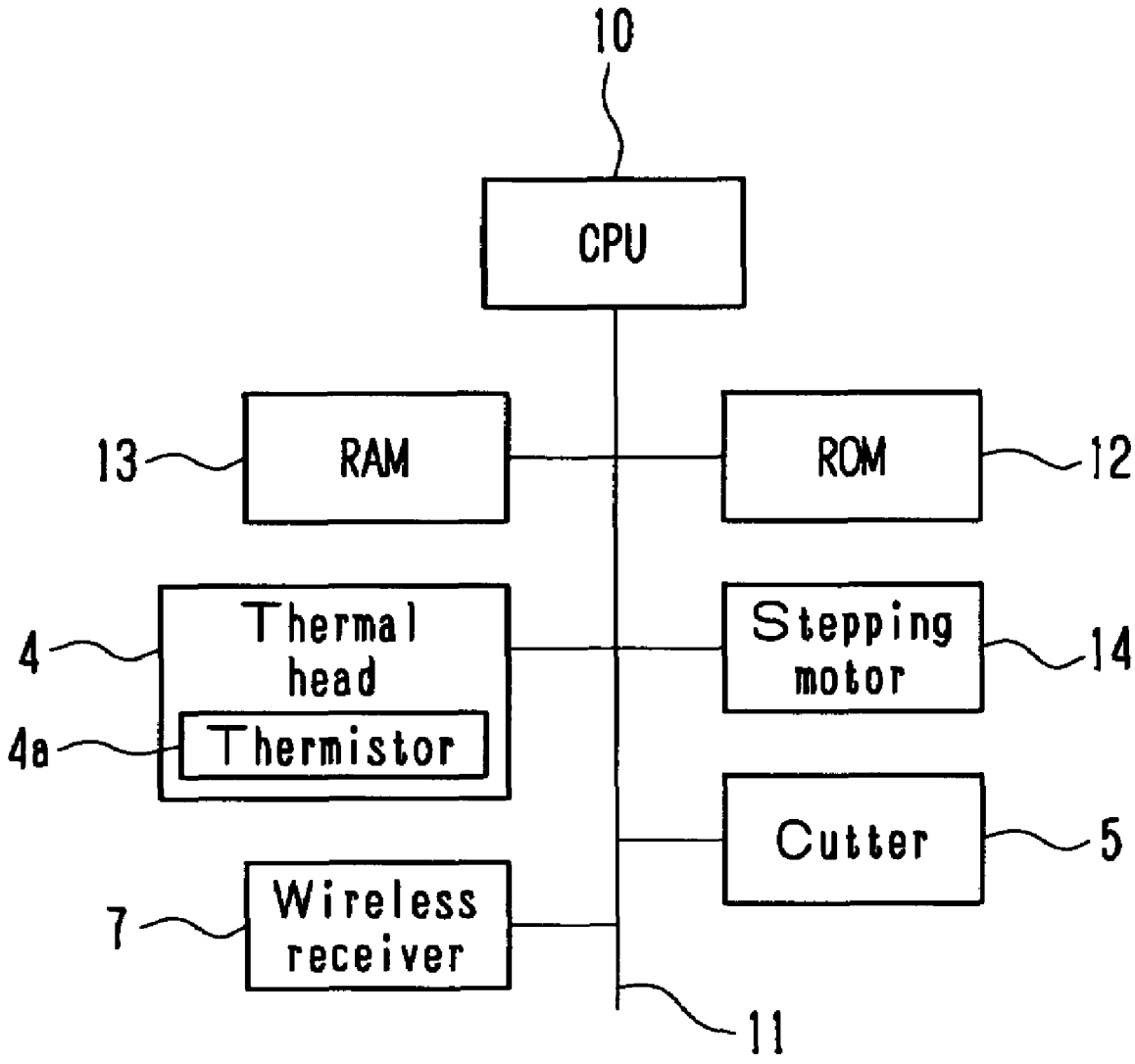
FIG. 3 is an electrical block diagram of a receipt printer.

FIG. 3 is an electrical block diagram of the receipt printer 1. The receipt printer 1 has a CPU (central processing unit) 10 which centrally controls various parts. The CPU 10 is connected through a system bus 11 with a ROM (Read Only Memory) 12 and a RAM (Random Access Memory) 13. The ROM 12 is a flash memory. The ROM 12 stores various programs for operating the receipt printer 1. The RAM 13 is used for example, as a work area for the programs stored in the ROM 12.

The CPU 10 is also connected through the system bus 11 with the thermal head 4, the cutter 5, the wireless receiver 7, and the stepping motor 14. In FIG. 3, driver circuits for the thermal head 4, cutter 5 and stepping motor 14 are not shown. The CPU 10 sends a drive signal to the cutter 5. The cutter 5 operates according to the drive signal and cuts the receipt paper 2 in the paper path 100. The stepping motor 14 drives the platen 3 according to a drive signal from the CPU 10. The platen 3 is rotated, to feeds the receipt paper 2 while driven by the stepping motor 14. The CPU 10 finds the temperature of the thermal head 4 according to the electrical current value of the thermistor 4*a* arranged in the thermal head 4.

Figure 4:
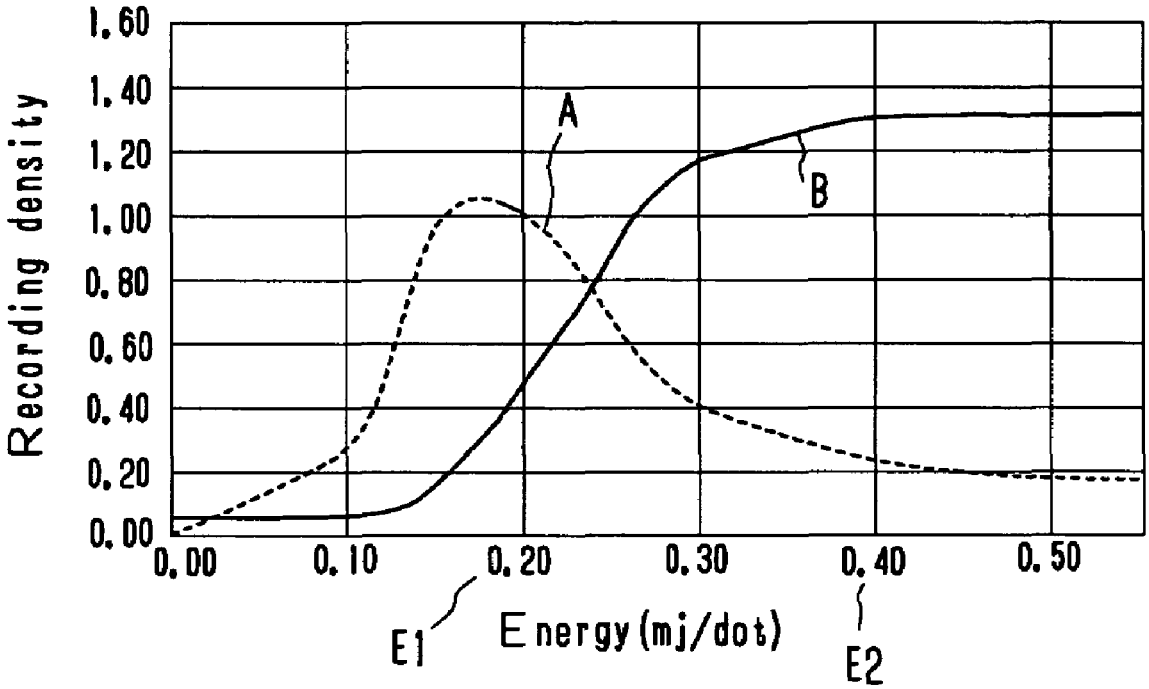
FIG. 4 is a graph showing color characteristics of 2-color heat-sensitive paper.

FIG. 4 is a graph showing color characteristics of 2-color heat-sensitive paper. In the figure, the vertical axis represents the recording density of the 2-color heat-sensitive paper and the horizontal axis represents the printing energy (mj/dot) applied to the 2-color heat-sensitive paper. In the receipt printer 1, the 2-color heat-sensitive paper can be used selectively. Here, 2-color heat-sensitive paper develops two colors (for example, black and blue) through the additive color process. The 2-color heat-sensitive paper may be used as the paper 2*b* of the receipt paper 2 may. One example of 2-color heat-sensitive paper is a lamination in which a black-developing layer and a blue-developing layer are sequentially laid over base paper. In FIG. 4, the broken line A expresses a "blue" characteristic and solid line B expresses a "black" characteristic. As shown in FIG. 4, blue appears with lower printing energy E1 (approx. 0.20 (mj/dot)) than black. FIG. 4 also shows that when printing energy E2 which is larger than the blue-developing printing energy is applied (approx. 0.40 (mj/dot), then the black appears over the blue. Therefore, when the receipt printer 1 must print in blue, a printing energy E1 (approx. 0.20 (mj/dot)) is applied to the receipt paper 2. When the receipt printer must print in black, a printing energy E2 (approx. 0.40 (mj/dot)) is applied to the receipt paper 2. Either printing energy E1 or E2 is selected by controlling the pulse width of electrical energy applied to the thermal head 4.

FIG. 5 is a schematic diagram showing a pulse width table. As shown in FIG. 5, the RFID tag 50 has a silicon chip which stores specification data for a consumable (receipt paper 2 in this embodiment). In this embodiment, the data is a pulse width table T. The pulse width table T defines the pulse width of the electrical energy for two colors (black and blue) which is supplied to the heating resistors of the thermal head 4. The pulse width depends on data on the temperature of the thermal head 4 which is detected by the thermistor (not shown). The temperature data includes a temperature range defined for each temperature rank.

One pulse width table T is provided for each of head resistance ranks 1 through 16. Therefore, the RFID tag 50 stores sixteen pulse width tables T which correspond to the head resistance ranks 1 through 16. Head resistance ranks are determined according to the resistance values of the heating resistors of the thermal head 4. The thermal head 4 has a jumper structure (not shown). The jumper structure determines the head resistance rank to be used.

FIG. 5 shows a pulse width table T for head resistance rank 1 as an example. This table T defines the pulse width of electrical energy for black and that for blue in a temperature range for each of the temperature ranks 0 through F. The pulse widths of electrical energy defined here are in inverse proportion to the head temperatures in order to minimize uneven print density that might be caused by fluctuations in the temperature of the thermal head 4.

Figure 6:
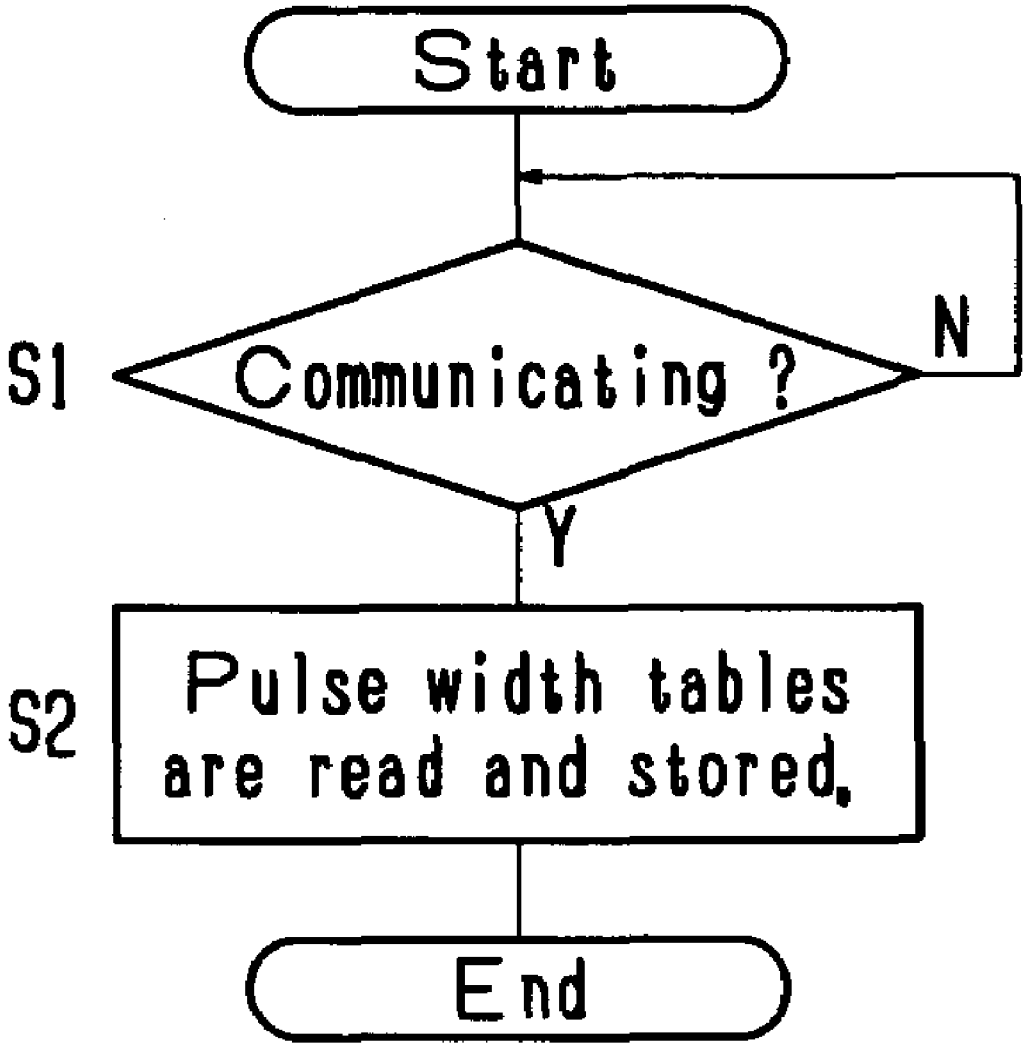
FIG. 6 is a flow chart outlining a printing condition adjustment process.

FIG. 6 is a flow chart schematically showing a printing condition adjustment process. The flow chart indicates the steps the CPU 10 takes according to the programs stored in the ROM 12. As the receipt paper 2 is loaded in the holder 6, the wireless receiver 7 starts data communication with the RFID tag 50 of the receipt paper 2. As shown in FIG. 6, when decided that communication between the wireless receiver 7 and the RFID tag 50 is established ("Y" at step S1), the wireless receiver 7 reads the pulse width tables stored in the silicon chip of the RFID tag 50. The pulse width tables T read by the wireless receiver 7 are stored in the RAM 13 (step S2). The CPU 10 controls the printing section 101 according to the pulse width tables T obtained from the RFID tag 50 through data communication.

During printing in black, the CPU 10 recognizes the head temperature detected by the thermistor attached to the head board of the thermal head 4. The CPU 10 then refers to the pulse width tables T stored in the RAM 13 and reads the pulse width for black which matches the temperature rank including the recognized head temperature. The CPU 10 then sends a head strobe signal corresponding to the read pulse width to the driver circuit (not shown) of the thermal head 4 to control the thermal head 4. The thermal head 4 in this way drives the heating resistors with the pulse width as defined in the corresponding pulse width table T. The characters are consequently printed in black on the receipt paper 2.

At printing in blue, the CPU 10 recognizes the head temperature detected by the thermistor attached to the head board of the thermal head 4. The CPU 10 then refers to the pulse width tables T stored in the RAM 13 and reads the pulse width for blue which matches the temperature rank including the recognized head temperature. The CPU 10 then sends a head strobe signal corresponding to the read pulse width to the driver circuit (not shown) of the thermal head 4 to control the thermal head 4. The thermal head 4 in this way drives the heating resistors with the pulse width as specified in the corresponding pulse width table T. The characters are consequently printed in blue on the receipt paper 2.

In this embodiment, the printing condition (pulse width of electrical energy in this embodiment) can therefore be automatically adjusted for a consumable (receipt paper 2 in this embodiment) according to the specification data for the consumable. Even when different types of receipt paper 2 are selectively used, making pulse width adjustments for different types of receipt paper 2 is easy.

FIG. 7 is a schematic diagram showing another example of a pulse width table. As shown in FIG. 7, a pulse width table T' stored in the silicon chip of the RFID tag 50 specifies the pulse width for each printing speed specified for each temperature range. More specifically, in the pulse width table T', the multiple printing speeds are set for each temperature range corresponding to the temperature ranks 0 through F and the pulse width of electrical energy for black and that for blue at each printing speed are specified. In the pulse width table T' shown in FIG. 7, pulse widths for blue and black are specified for each of three printing speeds: 10 (l/S), 6 (l/S) and 3 (l/S).

At printing in black, the CPU 10 recognizes the head temperature detected by the thermistor attached to the head board of the thermal head 4. The CPU 10 also recognizes the speed for the printing which is to start. The CPU 10 then refers to the pulse width tables T' stored in the RAM 13 and reads the pulse width for black which matches the temperature rank including the recognized head temperature and printing speed. The CPU 10 then sends a head strobe signal corresponding to the read pulse width to the driver circuit (not shown) of the thermal head 4 to control the thermal head 4. The thermal head 4 therefore drives the heating resistors with the pulse width as specified in the corresponding pulse width table T'. The characters are consequently printed in black on the receipt paper 2.

At printing in blue, the CPU 10 recognizes the head temperature detected by the thermistor attached to the head board of the thermal head 4. The CPU 10 also recognizes the speed of the printing which is to start. The CPU 10 then refers to the pulse width tables T' stored in the RAM 13 and reads the pulse width for blue which corresponds to the temperature rank including the recognized head temperature and printing speed. The CPU 10 then sends a head strobe signal corresponding to the read pulse width to the driver circuit (not shown) of the thermal head 4 to control the thermal head 4. The thermal head 4 in this way drives the heating resistors with the pulse width as specified in the corresponding pulse width table T'. The characters are consequently printed in blue on the receipt paper 2.

The thermal printer 1 can therefore make a fine adjustment of the printing energy of the thermal head 4 to the receipt paper 2 in accordance with the printing speed.

Another preferred embodiment of the present invention is described next while referring to FIGS. 8 through 13. The printer of this embodiment is a label printer. The label printer is a thermal transfer printer.

Figure 8:
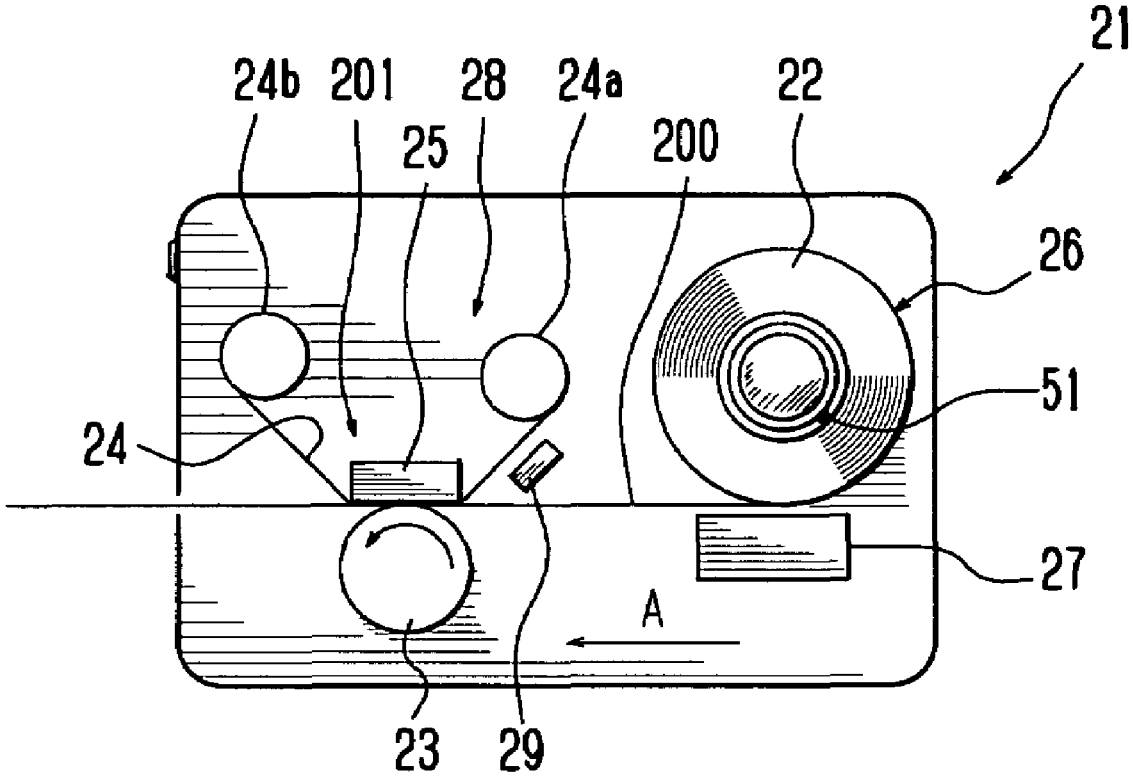
FIG. 8 is a longitudinal sectional side view schematically showing the structure of a label printer according to a second embodiment of the present invention.

FIG. 8 is a longitudinal sectional side view schematic showing the structure of a label printer 21. As shown in FIG. 8, the label printer 21 has a holder 26 which holds a roll of label paper 22. The label printer 21 has a platen 23 and a thermal head 25 facing the platen 23 with a paper path 200 between them. The platen 23 is rotated while driven by a stepping motor 35 (see FIG. 11) to feed the label paper 22 held by the holder 26 in the paper feeding direction A. The thermal head 25 is a print head with an array of heating resistors (not shown). The thermal head 25 has a thermistor 4*a* as a sensor for detecting the temperature of the thermal head 25 (see FIG. 11). The thermal head 25 performs printing on the label paper 22 by a thermal transfer process by selectively driving the heating resistors. The ink ribbon 24 therefore lies between the thermal head 25 and the label paper 22. The ink ribbon 24 is held by a ribbon holder 28 composed of a ribbon holding spindle 24*a* and a ribbon rewinding spindle 24*b*. The ink ribbon 24 held by the ribbon holding spindle 24*a* is rewound by the ribbon rewinding spindle 24 while guided in between the thermal head 25 and the label paper 22. The platen 23, thermal head 25, and ribbon holder 28 together comprise a printing section 201.

Figure 9:
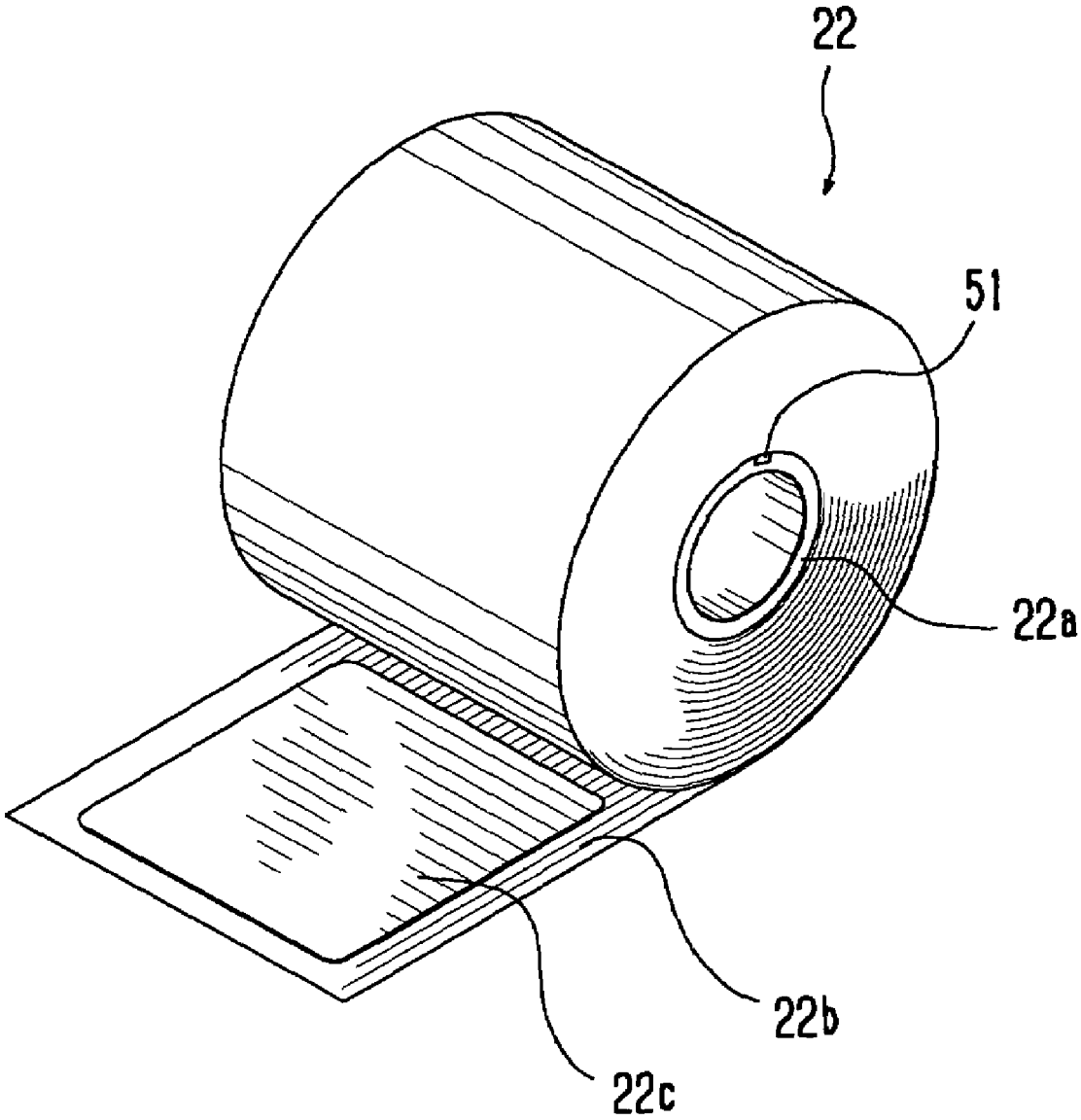
FIG. 9 is a perspective view showing a label paper.

FIG. 9 is a perspective view showing the label paper 22. The label paper 22 is consumed while the printing section 201 performs printing. The label paper 22 is therefore consumable. The label paper 22 comprises a cylindrical core 22*a*, a roll of base paper 22*b* (web) wound around the core 22*a*, and a label 22*c* bonded on the base paper 22*b*. The core 22*a*, base paper 22*b* and label 22*c* are consumables. An RFID tag 51 is embedded into the core 22*a*. The RFID tag 51 is composed of a silicon chip and an antenna and is capable of sending data to a wireless receiver.

Figure 10:
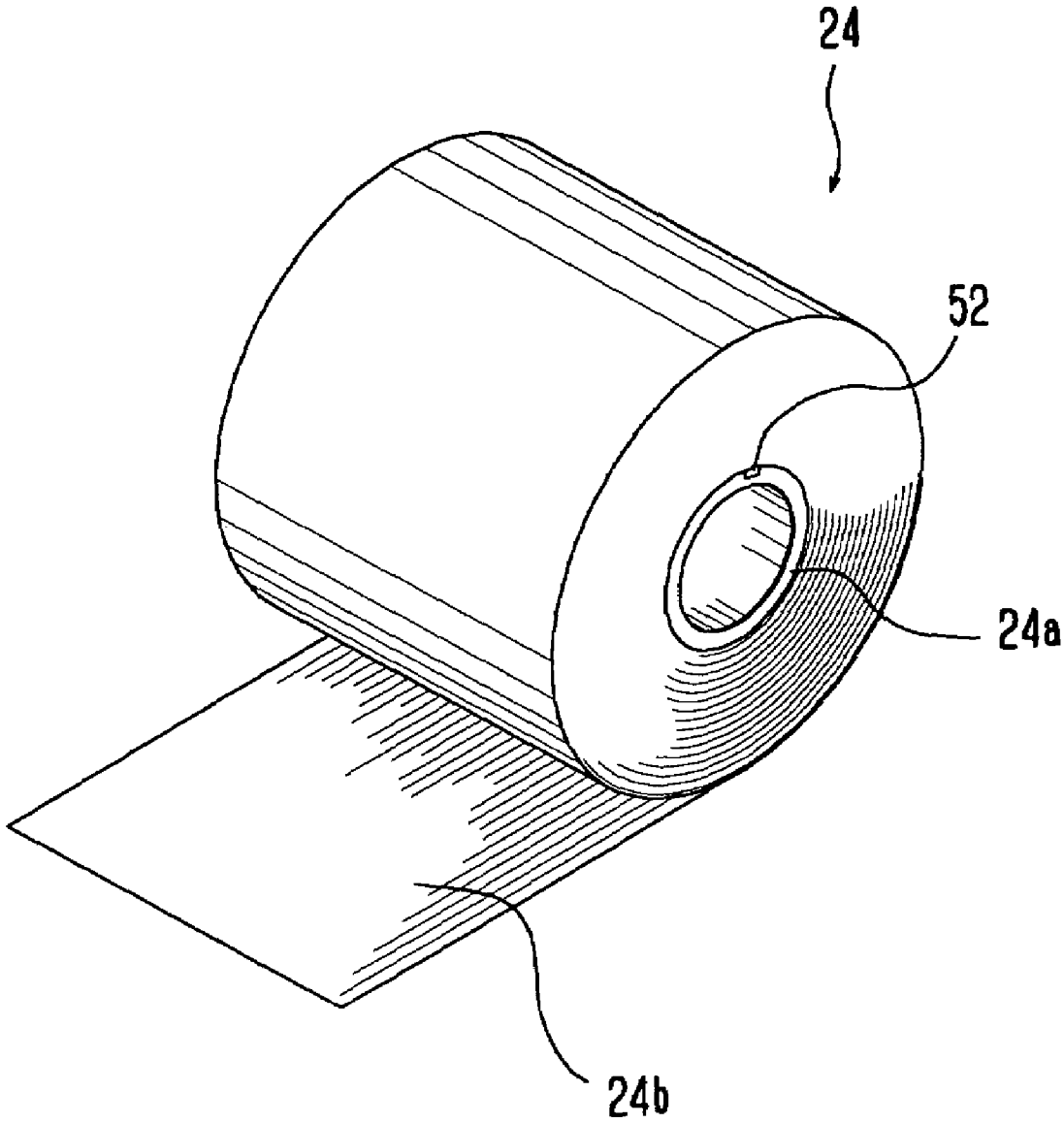
FIG. 10 is a perspective view showing an ink ribbon.

FIG. 10 is a perspective view showing the ink ribbon 24. The ink ribbon 24 is consumed while the printing section 201 performs printing. The ink ribbon 24 is therefore consumable. The ink ribbon 24 consists of a cylindrical core 24*a* and a roll of ribbon tape 22*b* (web type) wound around the core 24*a*. The core 24*a* and ribbon tape 24*b* are consumables. An RFID tag 52 is embedded into the core 24*a*. The RFID tag 52 is composed of a silicon chip and an antenna and is capable of sending data to a wireless receiver.

The label printer 21 receives data from the RFID tags 51 and 52 wirelessly. This means that the label printer 21 has a first wireless receiver 27 and a second wireless receiver 29. The first wireless receiver 27 is located near a holder 26 for holding the label paper 22. The second wireless receiver 29 is located near a ribbon holder 28 for holding the ink ribbon 24. An electrostatic coupling, electromagnetic coupling, electromagnetic induction, microwave or other method may be used for wireless communication between the RFID tags 51 and 52 and the wireless receivers 27 and 29.

Figure 11:
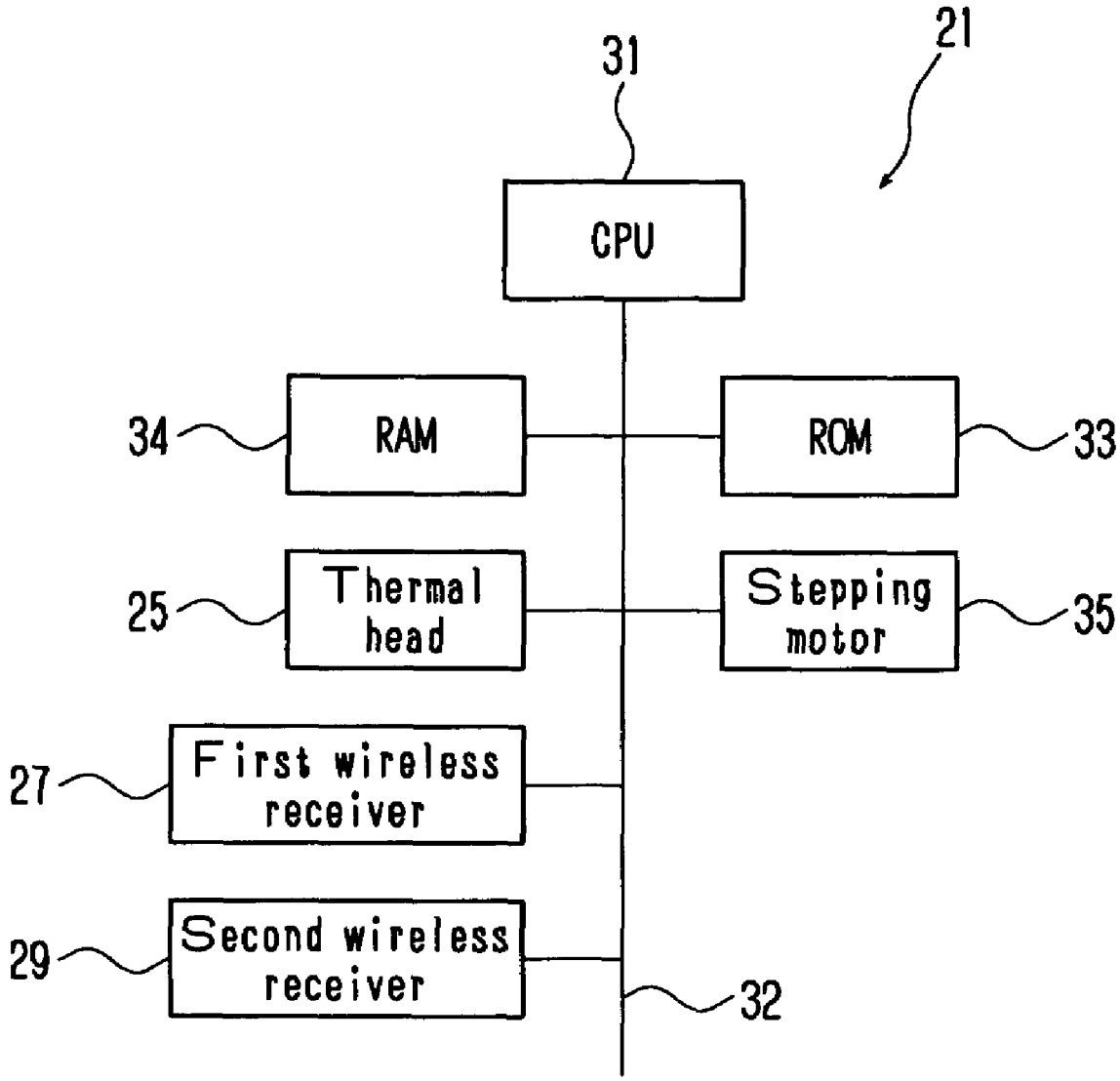
FIG. 11 is an electrical block diagram of a label printer

FIG. 11 is an electrical block diagram of the label printer 21. The label printer 21 has a CPU (central processing unit) 31 for centrally controlling the various parts. The CPU 31 is connected through a system bus 32 with a ROM (Read Only Memory) 33 and a RAM (Random Access Memory) 34. The ROM 33 consists of a flash memory. The ROM 33 stores various programs which operate the label printer 21. The RAM 34 is used for example, as a work area for the programs stored in the ROM 33.

The CPU 31 is also connected through the system bus 32 with the thermal head 25, the first and second wireless receivers 27 and 29, and the stepping motor 35. In FIG. 11, driver circuits for the thermal head 25 and stepping motor 35 are not shown. The stepping motor 35 drives the platen 23 and the ribbon rewinding spindle 24*b* according to a drive signal from the CPU 31. Driven by the stepping motor 35, the platen 23 is rotated, to feed the label paper 22. The CPU 31 recognizes the temperature of the thermal head 25 according to the electrical current value of the thermistor 4*a* installed in the thermal head 25.

FIG. 12 is a schematic diagram showing a pulse width table. In the label printer 21, one of different types of label paper 22 may be used in combination with one of different types of ink ribbon 24. Types of label paper 22 include rough paper, wood-free paper, coated paper and PET paper. Types of ink ribbon 24 include the wax type, semi-resin type and resin type. Wax type ink ribbon 24 is used with rough paper or wood-free paper as label paper 22. Semi-resin type ink ribbon 24 is used with rough paper, wood-free paper, coated paper or PET paper as label paper 22. Resin type ink ribbon 24 is used with coated paper or PET paper as label paper 22.

It should be noted that optimum printing conditions for the label paper 22 differ depending on the combination of label paper 22 and ink ribbon 24. These printing conditions for example, are the pulse width of the electrical energy supplied to the heating resistors of the thermal head 25 and the printing speed. The label printer 21 adjusts the various printing conditions for the label paper 22 depending on the combination of label paper 22 and ink ribbon 24. The label printer 21 uses wireless communication with the RFID tags to obtain data on the type of label paper 22 and the type of ink ribbon 24 to be used. The silicon chip of the RFID tag 51 of the label paper 22 stores data on the type of the label paper 22. The data concerns the specifications for the label paper 22. The silicon chip of the RFID tag 52 of the ink ribbon 24 stores data on the type of ink ribbon 24. The data concerns the specifications for the ink ribbon 24. The label printer 21 therefore obtains data on the type of label paper 22 to be used, through data communication between the wireless receiver 27 and the RFID tag 51 of the label paper 22. The label printer 21 also obtains data on the type of ink ribbon 24 to be used through data communication between the wireless receiver 29 and the RFID tag 52 of the ink ribbon 24.

In the label printer 21, a pulse width table t as shown in FIG. 12 is stored in the ROM 33. The pulse width table t specifies the pulse width of the electrical energy supplied to the heating resistors of the thermal head 25 depending on the combination of label paper 22 and ink ribbon 24. More specifically, depending on the combination of label paper 22 and ink ribbon 24, the pulse width table 1 specifies pulse widths for the three printing speeds: 10 (l/S), 6 (l/S) and 3 (l/S) as shown in FIG. 12. The label printer 21 in this way refers to data on the type of label paper 22 and the type of ink ribbon 24 obtained through wireless communication and retrieves the pulse width corresponding to the speed of printing that is going to start, from the pulse width table t. The label printer 21 selectively drives the heating resistors of the thermal head 25 according to the retrieved pulse width. In this way, the printing conditions are adjusted depending on the combination of label paper 22 and ink ribbon 24.

Figure 13:
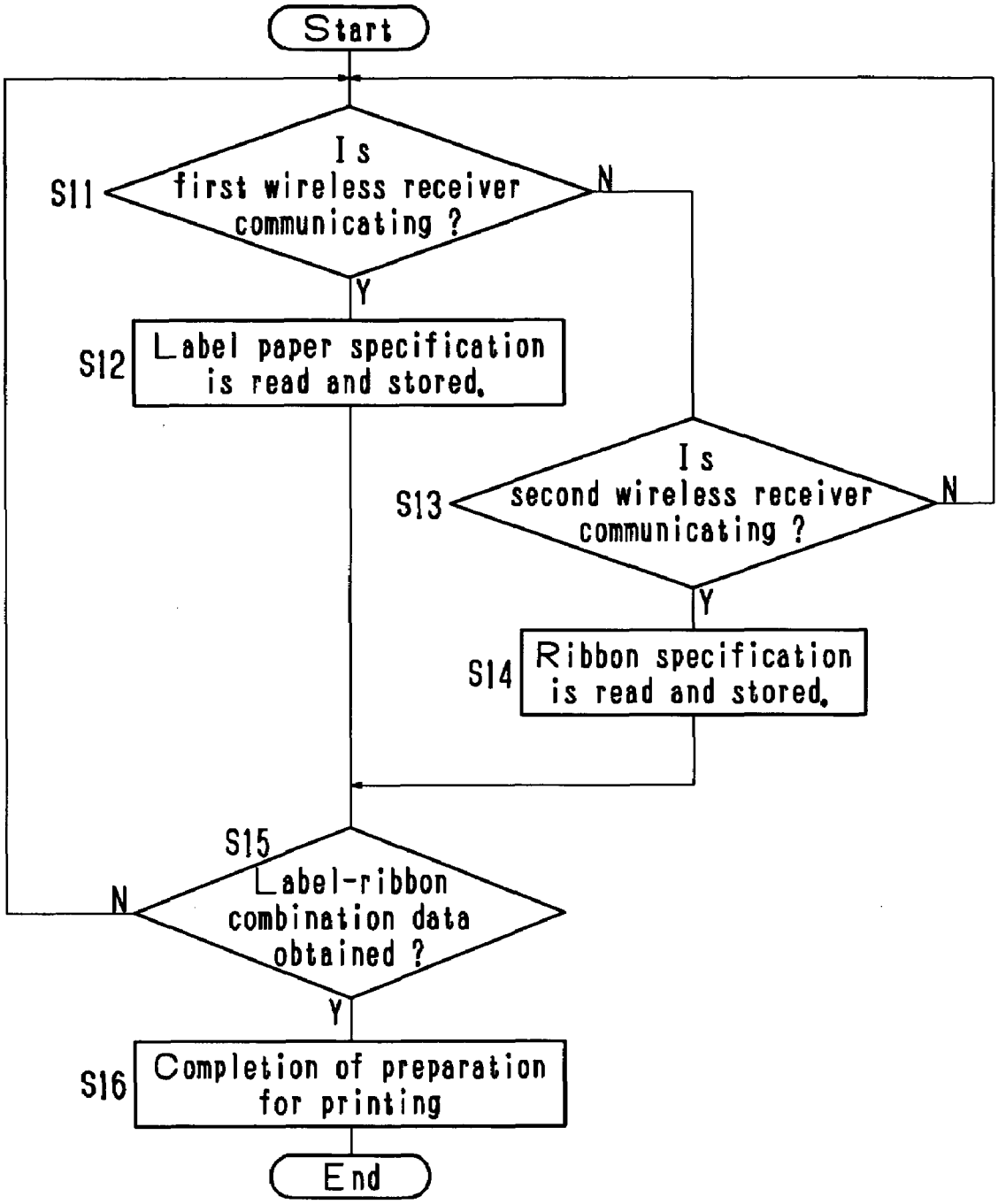
FIG. 13 is a flow chart outlining a printing condition adjustment process.

FIG. 13 is a flow chart showing the printing condition adjustment process. The flow chart indicates the steps the CPU 31 takes according to the programs stored in the ROM 33.

As the label paper roll 2 is loaded in the holder 26, the first wireless receiver 27 starts data communication with the RFID tag 51 of the label paper roll 22. As shown in FIG. 13, when decided that communication between-the-first wireless receiver 27 and the RFID tag 51 is established ("Y" at step S11), the first wireless receiver 27 reads the data on the type of label paper 22 stored in the silicon chip of the RFID tag 51. The data read by the first wireless receiver 27 is stored in the RAM 34 (step S12).

The second wireless receiver 29 starts data communication with the RFID tag 52 of the ink ribbon 24 when the ink ribbon 24 is loaded in the ribbon holder 28. As shown in FIG. 13, when decided that communication between the second wireless receiver 29 and the RFID tag 52 is established ("Y" at step S13), the second wireless receiver 29 reads the data on the type of ink ribbon 24 stored in the silicon chip of the RFID tag 52. The data read by the second wireless receiver 29 is stored in the RAM 34 (step S14).

At step S15, a decision is made whether data on the combination of data on the type of label paper 22 and data on the type of ink ribbon 24 has been obtained. If the CPU 31 decides that the combination data has been obtained (Y at step S15), then preparation for printing is completed (step S16). One example of the step for completion of preparation for printing is performed by using a flag or the like to establish the status.

During the actual printing, the CPU 31 recognizes the speed of the printing that is going to start. The CPU 31 then reads the pulse width of electrical energy from the pulse width table t according to the obtained combination data of label paper 22 type data and ink ribbon 24 type data and the recognized printing speed. The CPU 31 controls the printing section 201 with the pulse width that was read. In other words, the CPU 31 sends a head strobe signal corresponding to the read pulse width to the driver circuit (not shown) of the thermal head 25 to control the thermal head 25. When the printing section 201 is controlled in this way, the pulse width for reading from the pulse width table t is selected based on the combination data of label paper 22 type data and ink ribbon 24 type data which were respectively obtained from the RFID tag 51 and the RFID tag 52 through data communication. The CPU 31 in this way controls the printing section 201 according to data obtained from the RFID tags 51 and 52 through data communication.

Therefore, according to this embodiment, the printing condition (pulse width of electrical energy in this embodiment) is automatically adjusted according to the specification data on the consumables (label paper 22 and ink ribbon 24 in this embodiment). So even when different types of label paper 22 and ink ribbon 24 are used, adjusting the pulse width for each type of label paper 22 and each type of ink ribbon 24 is easy. The label printer 21 can make a fine adjustment of the printing energy of the thermal head 25 to be applied to the label paper 22 and ink ribbon 24 in accordance with the printing speed.

As explained so far, according to the present invention, various printing conditions for consumables can be automatically adjusted according to specification data for the consumable that is stored in an RFID tag. Therefore, even when different types of consumables are used, various printing conditions for various consumables can be easily adjusted.

Obviously, numerous modifications and variations of the present invention are possible in light of the above teachings. It is therefore to be understood that within the scope of the appended claims, the invention may be practiced otherwise than as specifically described herein.

What is claimed is:

1. A printer comprising:

a printing section including a print head;

a holder which holds at least one consumable consumed during a printing operation of the printing section, the consumable including an ink ribbon having an RFID tag storing specification data thereof indicating at least a type of the ink ribbon;

a wireless receiver which performs data communication with the RFID tag;

means for controlling the printing section based on the data obtained from the RFID tag via the data communication; and a memory for storing data indicating a pulse width of electrical energy in correspondence with the type of ink ribbon;

wherein the printing section is controlled with pulses of electrical energy in accordance with the data indicating the pulse width of electrical energy retrieved from the memory according to the type of ink ribbon indicated by the specification data obtained from the RFID tag.

2. A printer comprising:

a printing section including a print head;

a holder which holds at least two consumables consumed during a printing operation of the printing section, the consumables including (i) an ink ribbon having an RFID tag storing specification data thereof indicating at least a type of the ink ribbon, and (ii) label paper;

a wireless receiver which performs data communication with the RFID tag;

means for controlling the printing section based on the data obtained from the RFID tags via the data communication; and a memory for storing data indicating a pulse with of electrical energy in correspondence with the type of ink ribbon;

wherein the printing section is controlled with pulses of electrical energy in accordance with the data indicating the pulse width of electrical energy retrieved from the memory according to the type of ink ribbon indicated by the specification data obtained from the RFID tag.

3. A printer comprising:

a printing section including a print head;

a holder which holds at least two consumables consumed during a printing operation of the printing section, the consumables including (i) an ink ribbon having an RFID tag storing specification data thereof indicating at least a type of the ink ribbon, and (ii) label paper having an RFID tap storing specification data thereof indicating at least a type of the label paper;

at least one wireless receiver which performs data communication with the RFID tags;

means for controlling the printing section based on the data obtained from the RFID tags via the data communication; and a memory for storing data indicating a pulse width of electrical energy in correspondence with a combination of the type of ink ribbon and the type of label paper;

wherein the printing section is controlled with pulses of electrical energy in accordance with the data indicating the pulse width of electrical energy retrieved from the memory according to the combination of the type of ink ribbon and the type of label paper indicated by the specification data obtained from the RFID tags.

* * * * *